US010856628B2

(12) United States Patent
Wang et al.

(10) Patent No.: US 10,856,628 B2
(45) Date of Patent: Dec. 8, 2020

(54) SECURE ATTACHMENT DEVICE AND WEARABLE DEVICE UTILIZING ATTACHMENT DEVICE

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Hai-Tao Wang, Shenzhen (CN); Fu-Pin Hsieh, New Taipei (TW)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/426,157

(22) Filed: May 30, 2019

(65) Prior Publication Data

US 2020/0237055 A1 Jul. 30, 2020

(30) Foreign Application Priority Data

Jan. 25, 2019 (CN) ..... 2019 1 0071992

(51) Int. Cl.
*A44B 11/26* (2006.01)
*A44C 15/00* (2006.01)

(52) U.S. Cl.
CPC ..... *A44B 11/26* (2013.01); *A44C 15/005* (2013.01)

(58) Field of Classification Search
CPC ..... A44B 11/26; A44C 15/005
See application file for complete search history.

(56) References Cited

U.S. PATENT DOCUMENTS

| | | | | |
|---|---|---|---|---|
| 4,779,315 | A * | 10/1988 | Kohus | A44B 11/266 24/587.12 |
| 6,571,434 | B2 * | 6/2003 | Ortiz | A44B 11/006 24/265 BC |
| 10,555,570 | B2 * | 2/2020 | Pandolfino | A44B 17/0041 |
| 2003/0121129 | A1 * | 7/2003 | Hamilton | A44B 11/266 24/615 |
| 2019/0320744 | A1 * | 10/2019 | Pandolfino | A44B 6/00 |

* cited by examiner

*Primary Examiner* — Robert Sandy
*Assistant Examiner* — Louis A Mercado
(74) *Attorney, Agent, or Firm* — ScienBiziP, P.C.

(57) ABSTRACT

An attachment device for use with a wearable item includes a first cord end and a second cord end. The first cord end has restricting grooves and the second cord end has a buckle unit. The restricting grooves include a first groove and a second groove, and the buckle unit includes a first buckle and a second buckle. The first groove restricts the first buckle to an X-axis movement, and the second groove restricts the second buckle to movements along Y and Z axes when the first cord end is connected with the second cord end. The X, Y, and Z axes are each perpendicular to the other two. A wearable device using such an attachment device is also provided.

16 Claims, 7 Drawing Sheets

SECURE ATTACHMENT DEVICE AND WEARABLE DEVICE UTILIZING ATTACHMENT DEVICE

FIELD

The subject matter herein generally relates to attachment devices.

BACKGROUND

Nowadays, necklace-style wearable items are popular. The necklace-style wearable items can be mobile phones, pendants, necklaces, etc. The necklace-style wearable items generally have a cord. The cord forms a ring with two ends connected to suspend devices like a mobile phone. Thus, there is a need to make connecting and disconnecting of the cord easy to operate. There is also a need to make the end connectors of the cord strong and cannot be easily broken. In addition, aesthetics is a factor.

Therefore, there is room for improvement.

BRIEF DESCRIPTION OF THE DRAWINGS

Implementations of the present technology will now be described, by way of embodiments, with reference to the attached figures.

DETAILED DESCRIPTION

The present disclosure is made in conjunction with the accompanying drawings.

Specific embodiments of the present disclosure are described.

In the following description, when an element is described as being "fixed to" another element, the element can be fixed to another element with or without intermediate elements. When an element is described as "connecting" another element, the element can be connected to the other element with or without intermediate elements.

Without a given definition otherwise, all terms used have the same meaning as commonly understood by those skilled in the art. The term "and/or" means including any and all combinations of one or more of associated listed items. The terms such as "X-axis", "Y-axis", "Z-axis", and the like are only used to indicate relative positional relationships of objects, and when an absolute position of an object to be described is changed, relative positional relationships of the object to other objects are also changed accordingly.

Figure 1:
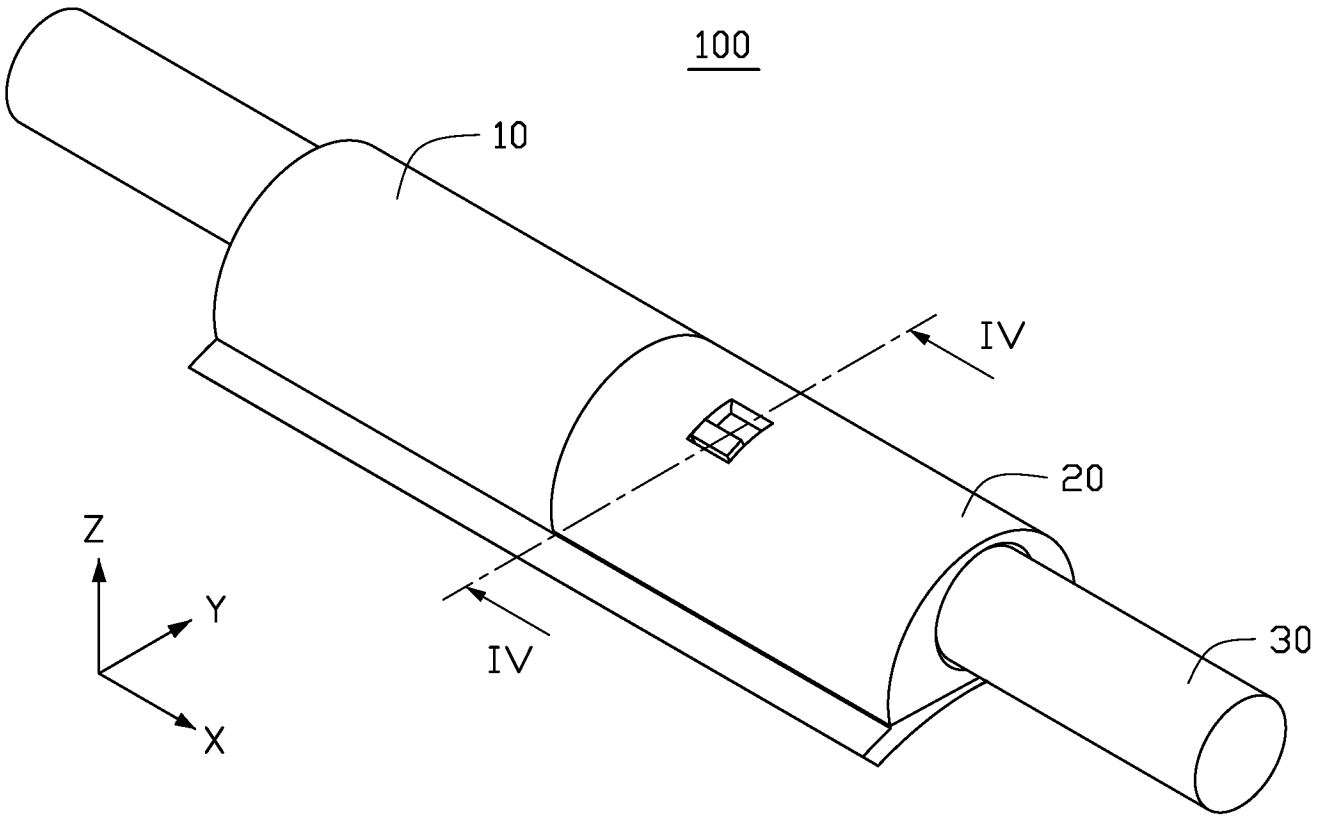
FIG. 1 is an isometric view of an attaching device according to an embodiment of the present disclosure.
Figure 2:
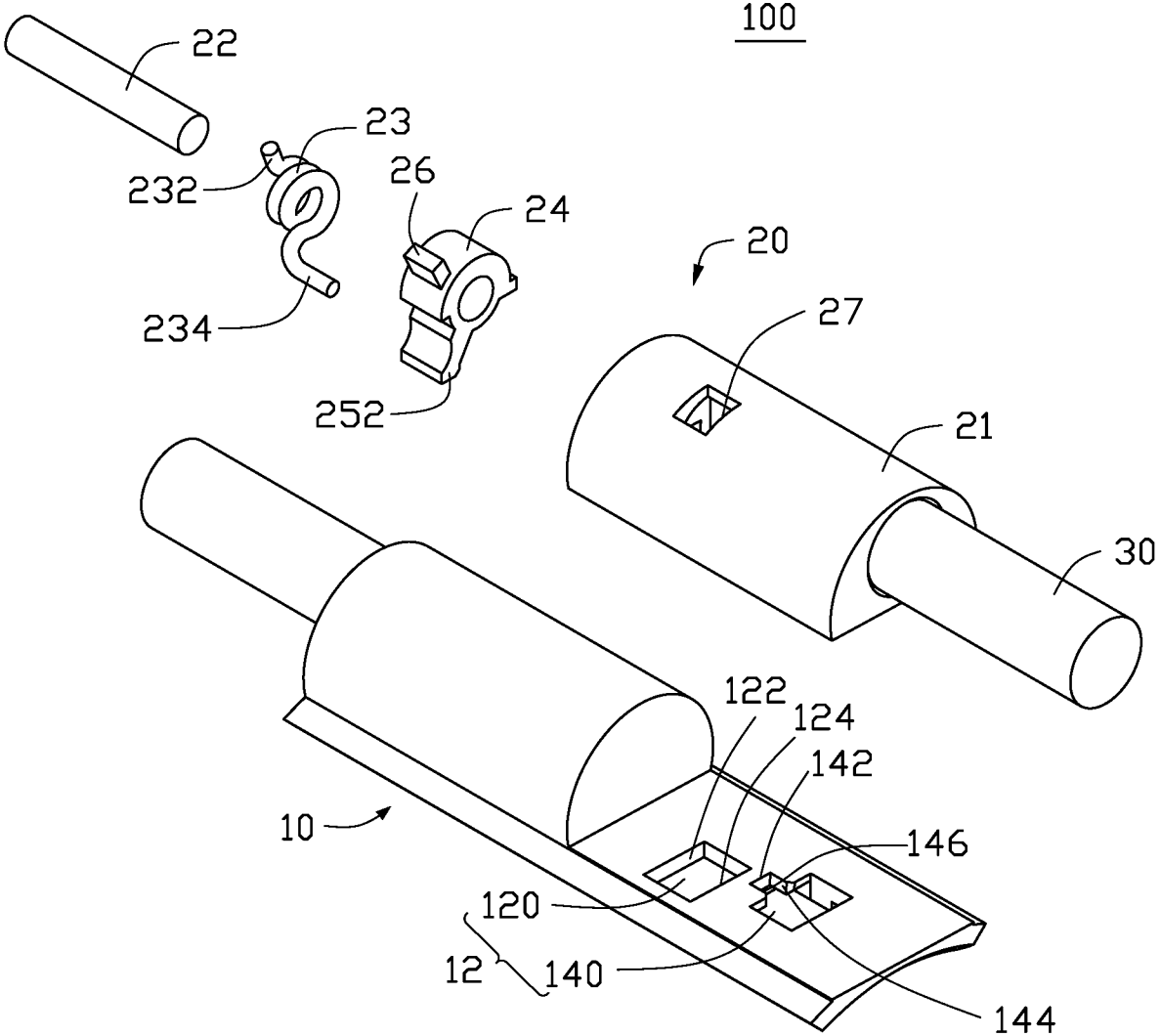
FIG. 2 is an exploded view of the device of FIG. 1.
Figure 3:
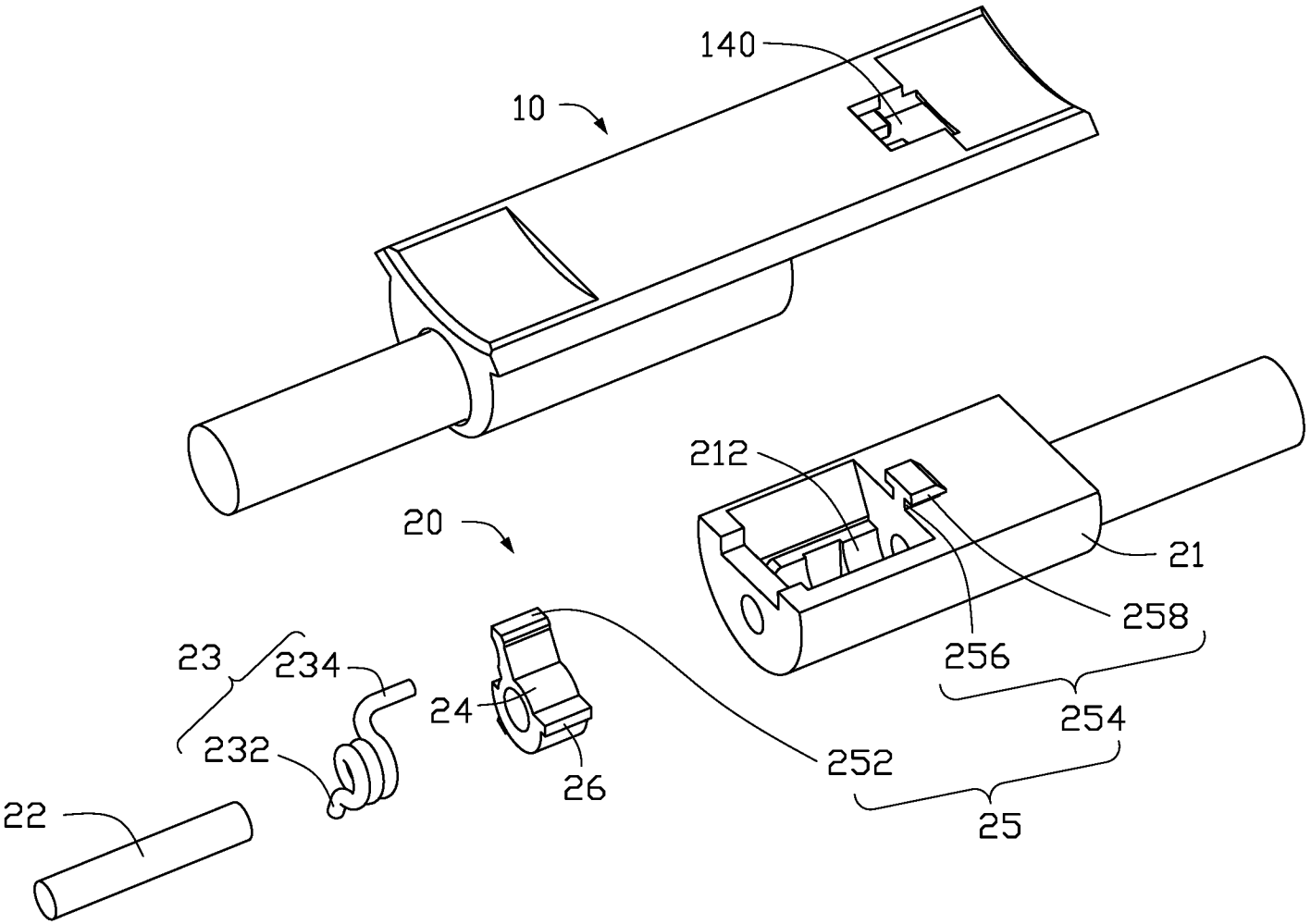
FIG. 3 is an exploded view of the device of FIG. 1 from another angle.

Referring to FIGS. 1-3, in an embodiment, the attachment device 100 of the present disclosure includes a first cord end 10 and a second cord end 20. The first cord end 10 and the second cord end 20 are opposite ends of a single cord (not shown) of a wearable device 30 (see FIG. 7), or are ends of two cords (not shown) which each has another opposite end permanently or detachably attached to the wearable device 30. The first cord end 10 is defined with restricting grooves 12, and the second cord end 20 is formed with a buckle unit 25, The buckle unit 25 can be clamped in the restricting grooves 12 to connect the first cord end 10 with the second cord end 20. The buckle unit 25 can also be disengaged from the restricting grooves 12, thereby disconnecting the second cord end 20 from the first cord end 10.

In the embodiment, the restricting groove 12 includes a first groove 120 and a second groove 140. The first groove 120 and the second groove 140 cooperate to limit movements of the buckle unit 25 along three dimensional directions including directions of an X-axis, a Y-axis and a Z-axis (hereinafter referred as "the X-axis directions", "the Y-axis directions" and "the Z-axis directions" respectively). Each of the X-axis, Y-axis and Z-axis is perpendicular to the other two, thereby achieving in all directions a movement restriction on the buckle unit 25 when the first cord end 10 is connected with the second cord end 20.

In the embodiment, the first groove 120 and the second groove 140 are both defined on the first cord end 10. The first groove 120 restricts the movement of the buckle unit 25 along the X-axis directions. The second groove 140 includes a recessed portion 142 that restricts the movements of the buckle unit 25 alon the Y-axis directions and the Z-axis directions.

In the embodiment, the buckle unit 25 includes a first buckle 252 and a second buckle 254. The first buckle 252 and the second buckle 254 are respectively disposed correspondingly to the first groove 120 and the second groove 140. The first buckle 252 is restricted in the first groove 120 and the second buckle 254 is restricted in the second groove 140. The second cord end 20 further includes a connecting shaft 22. The first buckle 252 is connected to the connecting shaft 22 through a first connecting member 24, The first connecting member 24 can be fixedly or movably connected to the connecting shaft 22. In the embodiment, the first connecting member 24 is sleeved on the connecting shaft 22. The first connecting member 24 is further formed with a pulling member 26. The pulling member 26 can be pulled by users to move the first buckle 252 into or out of the first groove 120. In another embodiment, the connecting shaft 22 is not necessary and can be omitted.

The second cord end 20 further includes an elastic member 23. The elastic member 23 is sleeved on the connecting shaft 22. The elastic member 23 can be deformed by an external force, and rebound to its initial state after the external force is removed. The elastic member 23 includes a fixed end 232 and a movable end 234. In the embodiment, the fixed end 232 is fixed to the connecting shaft 22 or a fixing unit 21 of the second cord end 20. The movable end 234 is movable relative to the fixed end 232. In the embodiment, the movable end 234 is in contact with the first buckle 252. When the first buckle 252 moves under the external force and disengages from the first groove 120, the first buckle 252 presses against the movable end 234 of the elastic member 23 and deforms the elastic member 23. When the external force is removed, the elastic member 23 rebounds and urges the first buckle 252 to return and re-engage with the first groove 120. In another embodiment, the movable end 234 is in contact with the pulling member 26. The pulling member 26 deforms the elastic member 23 during movement and the elastic member 23 urges the pulling member 26 to return to the initial position of the pulling member 26, thereby urging the first buckle 252 to return and re-engage with the first groove 120.

In the embodiment, the fixing unit 21 is semi-cylindrical in shape. A receiving groove 212 is defined on the fixing unit 21, facing the restricting groove 12. The connecting shaft 22 and the elastic member 23 are received in the receiving groove 212 and fixed to the fixing unit 21.

The second buckle 254 is fixed to the fixing unit 21 and is immovable relative to the fixing unit 21. In the embodiment, the second buckle 254 is formed on the fixing unit 21. The second buckle 254 includes a second connecting member 256 and a protruding portion 258. The protruding portion 258 is fixed to the fixing unit 21 through the second connecting member 256. The protruding portion 258 has a larger size than that of the second connecting member 256 along the Y-axis directions. In other embodiment, the second buckle 254 may be formed on the connecting shaft 22 in the case the connecting shaft 22 is fixed and cannot be rotated.

In the embodiment, the first groove 120 is rectangular in shape. The first groove 120 has a first groove wall 122 and a second groove wall 124 opposite and symmetrical to the first groove wall 122, The first groove wall 122 and the second groove wall 124 are substantially perpendicular to the X-axis directions such that the first groove 120 restricts the first buckle 252 along the X-axis directions. The second groove 140 includes a recessed portion 142 having an opening in one of the X-axis directions and two opposite openings in the Z-axis directions. The recessed portion 142 further has a first recessing wall 144 and a second recessing wall 146 opposite to the first recessing wall 144. The first recessing wall 144 and the second recessing wall 146 restrict a movement of the second buckle 254 along the Y-axis directions. In the embodiment, a distance between the first recessing wall 144 and the second recessing wall 146 along the Y-axis directions is larger than or equal to a size of the second connecting member 256 but is less than a size of the protruding portion 258 in that directions. The second connecting member 256 can be moved into the recessed portion 142 and received in the recessed portion 142 through the opening in the X-axis directions. After the second connecting member 256 is received in the recessed portion 142, the first cord end 10 serves as a blocking member for blocking movement of the protruding portion 258 along the Y-axis directions, thereby restricting movement of the second buckle 254 along the Z-axis directions.

In the embodiment, the elastic member 23 is a torsion spring. The elastic member 23 and the first connecting member 24 are sleeved on the connecting shaft 22. The elastic member 23, the first connecting member 24 and the connecting shaft 22 are received in the receiving groove 212 of the fixing unit 21. The connecting shaft 22 is fixed on the fixing unit 21. The fixed end 232 of the elastic member 23 is fixed to the connecting shaft 22, and the movable end 234 of the elastic member 23 abuts against the first buckle 252. The first buckle 252 is fixed on the first connecting member 24. An opening 27 is defined on the fixing unit 21 to expose the pulling member 26, the user may thus connect the first cord end 10 with the second cord end 20 or disconnect the first cord end 10 from the second cord end 20, The pulling member 26 can be rotated around the connecting shaft 22 by the user and rotate the first connecting member 24. The first connecting member 24 drives the first buckle 252 to rotate out of the first groove 120, thus disconnecting the first cord end 10 from the second cord end 20. The first buckle 252 in turn urges the movable end 234 of the elastic member 23 to move and deforms the elastic member 23. In another embodiment, the movable end 234 of the elastic member 23 can be connected to the first connecting member 24. When the pulling member 26 is pulled to rotate the first connecting member 24, the first connecting member 24 drives the first buckle 252 to move out of the first groove 120. Meanwhile the first connecting member 24 drives the movable end 234 of the elastic member 23 to deform the elastic member 23. When the user releases the pulling member 26, the elastic member 23 rebounds and rotates the first connecting member 24 back, thereby the pulling member 26 returns to its initial position.

Figure 4:
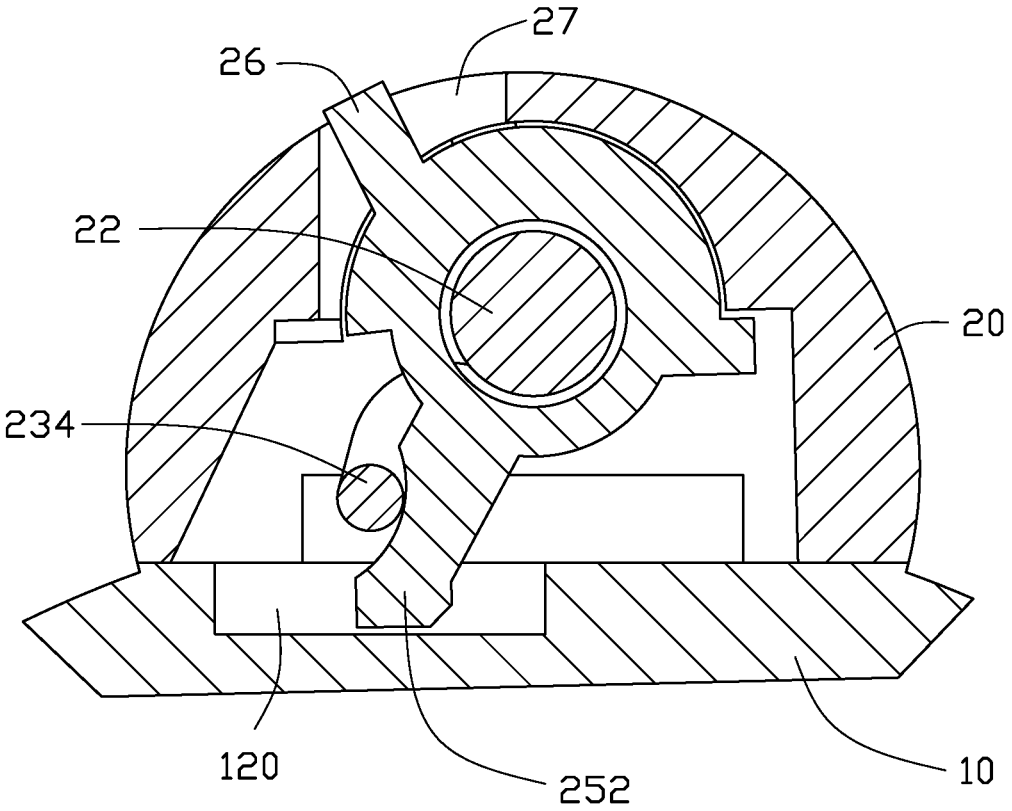
FIG. 4 is a cross-sectional view taken along line IV-IV of FIG. 1, showing device in a first state.
Figure 5:
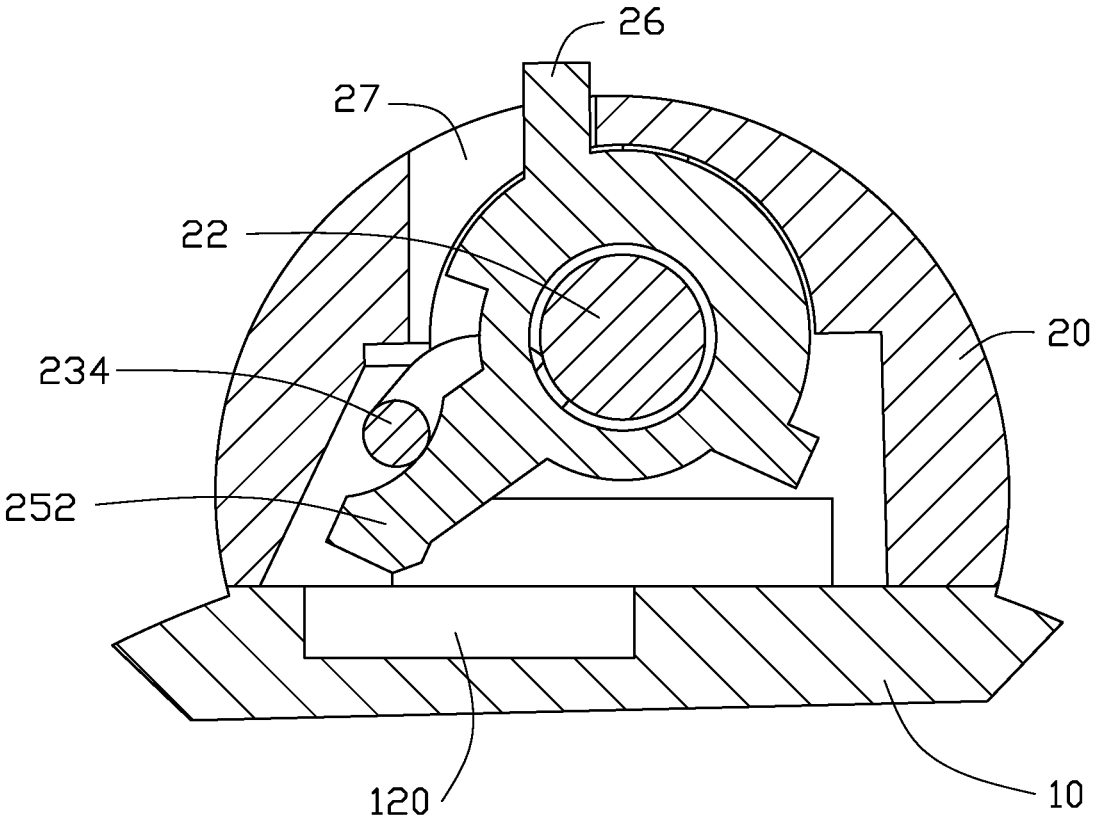
FIG. 5 is a cross-sectional view showing device in a second state.

Referring to FIG. 2, FIG. 4, and FIG. 5, when the first cord end 10 is connected with the second cord end 20, the first buckle 252 is received in the first groove 120. The first groove wall 122 and the second groove wall 124 block the first buckle 252 from moving along the X-axis directions. The second buckle 254 is received in the second groove 140 and restricted by the recessed portion 142. In detail, the first recessing wall 144 and the second recessing wall 146 of the second groove 140 block the second connecting member 256 of the second buckle 254 from moving along the Y-axis directions. The first cord end 10 serves as a blocking member blocking the protruding portion 258 of the second buckle 254 from moving along the Z-axis directions. To disconnect the first cord end 10 from the second cord end 20, the pulling member 26 is pulled toward a first direction. The pulling member 26 rotates in the first direction about the connecting shaft 22 and drives the first connecting member 24 to rotate. The first connecting member 24 in turn drives the first buckle 252 to rotate out of the first groove 120, thus disengaging the first buckle 252 from the first groove 120 and releasing the restriction on the movement of the first buckle 252 along the X-axis directions. Then, the second cord end 20 is moved along the X-axis directions and drives the fixing unit 21 with it, thereby driving the second buckle 254 to move along the X-axis directions and out of the recessed portion 142. The restrictions on movement of the second buckle 254 along the Y-axis directions and Z-axis directions are both released and the first cord end 10 is disconnected from the second cord end 20. The second cord end 20 is further moved along the Z-axis directions and out of the second groove 140. When the pulling member 26 is released, the elastic member 23 rebounds and drives the first connecting member 24 to rotate back, thereby the pulling member 26 returns to its initial position.

To connect the first cord end 10 with the second cord end 20, the second buckle 254 is placed in the second groove 140 and moved along the X-axis directions to be received in the recessed portion 142. Movements of the second buckle 254 along the Y-axis directions and Z-axis directions are thereby restricted. The pulling member 26 is pulled along the first direction and then released, the elastic member 23 rebounds and drives the pulling member 26 to rotate back to the initial position, Meanwhile the elastic member 23 drives the second connecting member 256 to rotate, driving the first buckle 252 to rotate into the first groove 120 and be restricted by the first groove 120 along the X-axis directions. With the first buckle 252 restricted in the first groove 120 along the X-axis directions and the second buckle 254 restricted in the recessed portion 142 of the second groove 140 along the Y-axis directions and the Z-axis directions, the first cord end 10 is connected with the second cord end 20.

Figure 6:
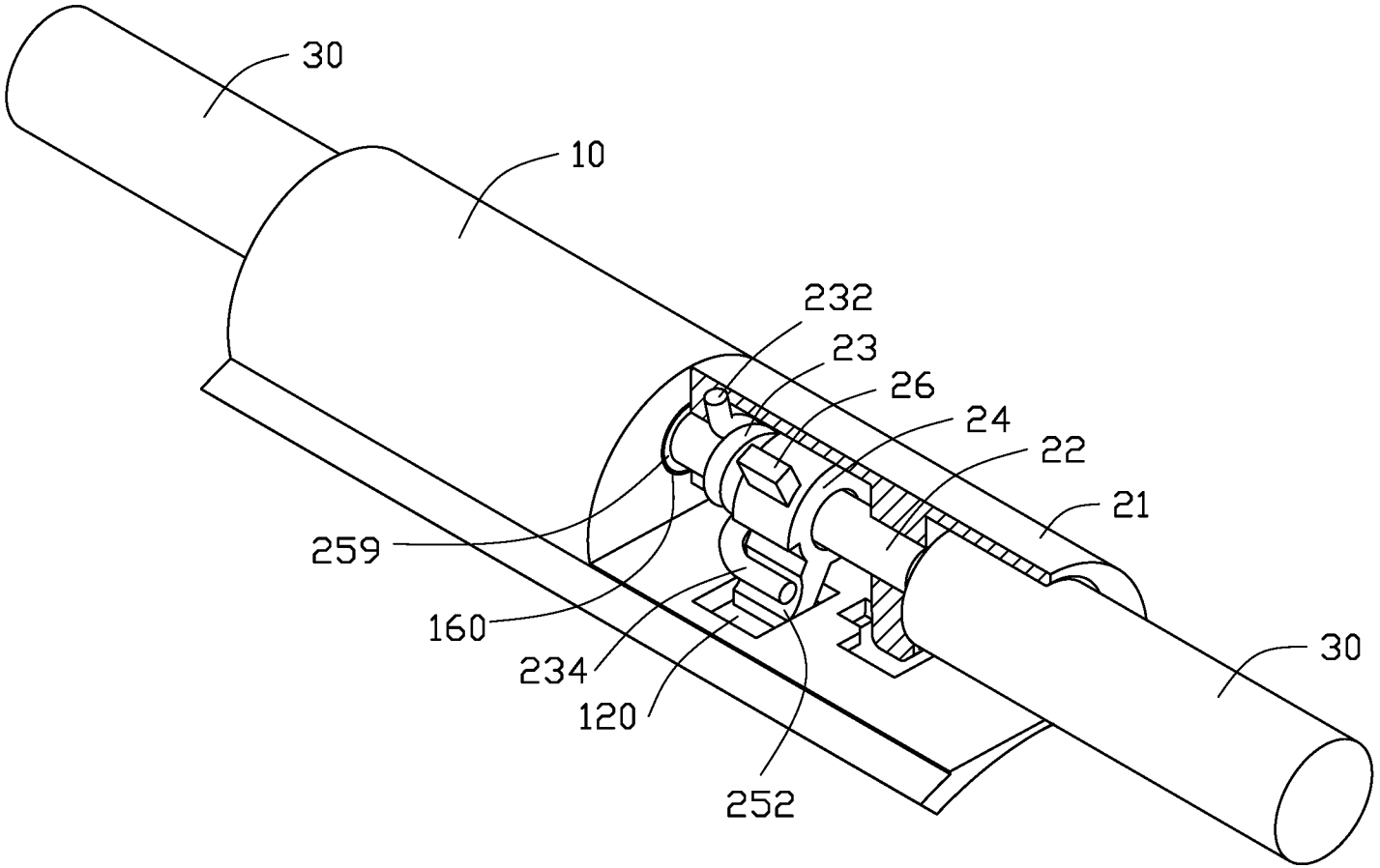
FIG. 6 is a sectional view of part of the device of FIG. 1.

Referring to FIG. 6, in the embodiment, the first cord end 10 is defined with a third groove 160. The third groove 160 faces an axial direction of the connecting shaft 22. The second cord end 20 is formed with a third buckle 259 corresponding to the third groove 160.

In the embodiment, the third groove 160 is a cylindrical groove having a groove bottom (not shown) and a groove wall (not shown). The third buckle 259 is cylindrically shaped and is formed at one end of the connecting shaft 22. When the first cord end 10 and the second cord end 20 are connected, one end side of the third buckle 259 resists against the groove bottom of the third groove 160 and prevents the third buckle 259 from moving along one direction of the X-axis directions. Meanwhile, the groove wall of the third groove 160 prevents the third buckle 259 from moving along the Y-axis and Z-axis directions. In another embodiment, the third groove 160 and the third buckle 259 can be omitted.

Figure 7:
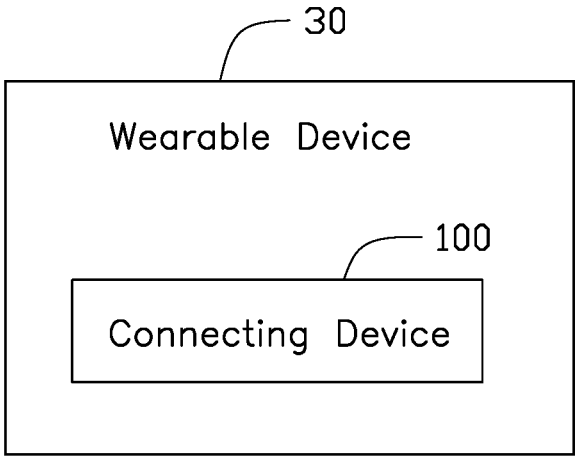
FIG. 7 is a schematic view of a wearable device using the device of FIG. 1.

Referring to FIG. 7, a wearable device 30 which includes the attachment device 100 is shown. The wearable device 30 can be a necklace-type smart device, a necklace, a bracelet, an ornament, or the like.

The attachment device provided by the present disclosure is simple in construction and operation, and convenient for wearing. The attachment device is hidden in the fixing unit 21, and only the pulling member 26 is exposed, for better aesthetics.

The embodiments shown and described above are only examples. Even though numerous characteristics and advantages of the present technology have been set forth in the foregoing description, together with details of the structure and function of the present disclosure, the disclosure is illustrative only, and changes can be made in the detail, including in matters of shape, size, and arrangement of the parts within the principles of the present disclosure, up to and including the full extent established by the broad general meaning of the terms used in the claims.

What is claimed is:

1. An attachment device comprising:

a first cord end and a second cord end;

a plurality of restricting grooves being defined on the first cord end, each of the plurality of restricting grooves comprising a first groove and a second groove;

a buckle unit being formed on the second cord end, the buckle unit comprising a first buckle and a second buckle;

a first connecting member and a pulling member; and an elastic member comprising a fixed end and a movable end;

wherein the first groove restricts movement of the first buckle along directions of an X-axis, and the second groove restricts movement of the second buckle along directions of a Y-axis and a Z-axis when the first cord end is connected with the second cord end, and each of the X-axis, the Y-axis and the Z-axis is perpendicular to each other;

wherein the first buckle and the pulling member are fixed to the first connecting member, the pulling member is configured to be pulled to drive the first connecting member to move, thereby moving the first buckle out of the first groove;

wherein the movable end abuts against the first buckle or against the pulling member, the pulling member is configured to be pulled to deform the elastic member, and the elastic member rebounds to drive the pulling member and the first buckle to return initial positions when the elastic member is released.

2. The attachment device as claimed in claim 1, wherein the first groove comprises a first groove wall and a second groove wall opposite to the first groove wall and spaced from the first groove wall on the X-axis, the first groove wall and the second groove wall corporately restrict movement of the first buckle along the directions on the X-axis.

3. The attachment device as claimed in claim 1, further comprising a connecting shaft and a fixing unit, the first buckle being connected to the connecting shaft through the first connecting member, the second buckle being formed on the fixing unit or on the connecting shaft.

4. The attachment device as claimed in claim 3, wherein the second buckle comprises a second connecting member and a protruding portion, the protruding portion is connected to the fixing unit or to the connecting shaft through the second connecting member, a size of the protruding portion along the Y-axis is larger than a size of the second connecting member in the Y-axis.

5. The attachment device as claimed in claim 4, wherein the second groove comprises a recessed portion defining an opening in one of the directions of the X-axis and two opposite openings in the Z-axis, the recessed portion comprises a first recessing wall and a second recessing wall, the second recessing wall is opposite to the first recessing wall and spaced from the first recessing wall at a distance in the Y-axis, the distance is larger than or equal to the size of the second connecting member but less than the size of the protruding portion in the Y-axis, the recessed portion restricts movement of the second buckle along the directions in the Y-axis and directions in the Z-axis when the second connecting member is received between the first recessing wall and the second recessing wall.

6. The attachment device as claimed in claim 5, wherein the first buckle is received in the first groove and the second connecting member of the second buckle is received in the recessed portion of the second groove to connect the first cord end with the second cord end, the first buckle is moved out of the first groove and the second connecting member of the second buckle is moved out of the recessed portion of the second groove to disconnect the first cord end from the second cord end.

7. The attachment device as claimed in claim 3, wherein the first cord end is further defined with a third groove, and the second cord end is formed with a third buckle engaging with the third groove when the first cord end is connected with the second cord end.

8. The attachment device as claimed in claim 7, wherein the third groove faces an axis direction of the connecting shaft, the third buckle is formed on an end of the connecting shaft.

9. A wearable device comprising:

an attachment device, the attachment device comprising:

a first cord end and a second cord end;

a plurality of restricting grooves being defined on the first cord end, each of the plurality of restricting grooves comprising a first groove and a second groove;

a buckle unit being formed on the second cord end, the buckle unit comprising a first buckle and a second buckle;

a first connecting member and a pulling member; and an elastic member comprising a fixed end and a movable end;

wherein the first groove restricts movement of the first buckle along directions of an X-axis, and the second groove restricts movement of the second buckle along directions of a Y-axis and a Z-axis when the first cord end is connected with the second cord end, and each of the X-axis, the Y-axis and the Z-axis is perpendicular to each other;

wherein the first buckle and the pulling member are fixed to the first connecting member, the pulling member is configured to be pulled to drive the first connecting member to move, thereby moving the first buckle out of the first groove;

wherein the movable end abuts against the first buckle or against the pulling member, the pulling member is configured to be pulled to deform the elastic member, and the elastic member rebounds to drive the pulling member and the first buckle to return initial positions when the elastic member is released.

10. The wearable device as claimed in claim 9, wherein the first groove comprises a first groove wall and a second groove wall opposite to the first groove wall and spaced from the first groove wall on the X-axis, the first groove wall and the second groove wall corporately restrict movement of the first buckle along the directions on the X-axis.

11. The wearable device as claimed in claim 9, wherein the attachment device further comprises a connecting shaft and a fixing unit, the first buckle is connected to the connecting shaft through the first connecting member, the second buckle is formed on the fixing unit or on the connecting shaft.

12. The wearable device as claimed in claim 11, wherein the second buckle comprises a second connecting member and a protruding portion, the protruding portion is connected to the fixing unit or to the connecting shaft through the second connecting member, a size of the protruding portion along the Y-axis is larger than a size of the second connecting member in the Y-axis.

13. The wearable device as claimed in claim 12, wherein the second groove comprises a recessed portion defining an opening in one of the directions of the X-axis and two opposite openings in the Z-axis, the recessed portion comprises a first recessing wall and a second recessing wall, the second recessing wall is opposite to the first recessing wall and spaced from the first recessing wall at a distance in the Y-axis, the distance is larger than or equal to the size of the second connecting member but less than the size of the protruding portion in the Y-axis, the recessed portion restricts movement of the second buckle along the directions in the Y-axis and directions in the Z-axis when the second connecting member is received between the first recessing wall and the second recessing wall.

14. The wearable device as claimed in claim 13, wherein the first buckle is received in the first groove and the second connecting member of the second buckle is received in the recessed portion of the second groove to connect the first cord end with the second cord end, the first buckle is moved out of the first groove and the second connecting member of the second buckle is moved out of the recessed portion of the second groove to disconnect the first cord end from the second cord end.

15. The wearable device as claimed in claim 11, wherein the first cord end is further defined with a third groove, and the second cord end is formed with a third buckle engaging with the third groove when the first cord end is connected with the second cord end.

16. The wearable device as claimed in claim 15, wherein the third groove faces an axis direction of the connecting shaft, the third buckle is formed on an end of the connecting shaft.

* * * * *